US007270217B1

(12) United States Patent
Haney

(10) Patent No.: US 7,270,217 B1
(45) Date of Patent: Sep. 18, 2007

(54) EXTERIOR FIRE RESISTANT, PASSENGER ELEVATOR SYSTEM

(76) Inventor: Marrell Haney, 1301 w. 96th st., Chicago, IL (US) 60643

( * ) Notice: Subject to any disclaimer, the term of this patent is extended or adjusted under 35 U.S.C. 154(b) by 1 day.

(21) Appl. No.: 11/414,973

(22) Filed: May 1, 2006

(51) Int. Cl.
*B66B 9/00* (2006.01)

(52) U.S. Cl. ..... 187/239; 182/37; 182/82; 212/79

(58) Field of Classification Search ..... 187/239; 182/37, 82; 212/179
See application file for complete search history.

(56) References Cited

U.S. PATENT DOCUMENTS 447,898 A * 3/1891 Nygren ..... 182/14
4,469,198 A * 9/1984 Crump ..... 182/141
4,811,819 A * 3/1989 Sugiyama ..... 182/37
4,921,070 A * 5/1990 Magill ..... 182/142
4,979,589 A * 12/1990 Sugiyama et al. ..... 182/38

* cited by examiner

*Primary Examiner*—Gene O. Crawford
*Assistant Examiner*—Terrell Matthews

(57) ABSTRACT

The methodology and advantages that are provided in the present invention are intended to provide assistance to fire fighters and other emergency care-givers with life saving tools during fires and other smoke related emergencies that render fire and smoke victims helpless and trapped inside of high-rise buildings.

The exterior fire resistance elevator system, having several specialized component devices that are adapted for lifting and rotating the elevator in a vertical and horizontal directions. The elevator is also capable of moving in tandem in a vertical and horizontally direction as directed by an elevator operator or by an operator having location in a central station that is at ground level or near the building.

An electric motor device having pulley wheel devices at the left and right end of the motor are preferred rotaters that function to lift and rotate the elevator, which is provided with wheel components that connect to axle devices, having base connections to several elevator housing mechanisms. A trolley machine car is designed to provide several functions including transporting the main vertical elevator as it moves on horizontal rail tracks that are erected on buildings roof tops.

23 Claims, 15 Drawing Sheets

EXTERIOR FIRE RESISTANT, PASSENGER ELEVATOR SYSTEM

BACKGROUND OF THE INVENTION

Field of the Invention

It is an object of the invention to provide an peripheral ode of rescue and escape from smoke and fires that occur in tall buildings through the use of state of the art exterior elevator system that is adapted for firemen to reach fire victims and rescuing them with an elevator that is adapted for vertical and horizontal movements. Similar descriptions of prior Art includes exterior scaffolds which are commonly used for tuck pointing and window washing on building that are too tall for ladders. There are other exterior lifting devices that are manipulated by operators of heavy machinery which are mainly for transporting and lifting construction materials. The break through that provide an exterior mode of vertical and horizontal movements through the use of an exterior fire resistant passenger's elevator will make fighting fires and rescuing fire and smoke victims much easier for first responders who would usually be required to climb smoke filled stairs in desperately attempts to reach trapped fire victims. The present invention having a trolley machine car that is powered by electric motors and rotates on roof top track systems, and is also adapted for carrying the elevator on a vertical double track horizontal system that provide a ways for the elevator to be used in other locations of buildings. Office workers are also provided with a real way to escape from smoke and fires with the use of elevator 22. It is the object of the present invention to provide a fire escape system that is build for proficient in rescuing individuals who have no safe means of from smoke and fires without a system that is provided for rescuing fire victims externally through windows of buildings to avoid injuries or death by escaping from the buildings. Necessary tools are for maneuvering the cable controlled exterior elevator as it moves in a vertical and horizontal direction to different locations of a building. The exterior elevator system having emergency fire equipments and other life saving component parts including on board sensors and motion controls is also provided with wheels that joined to elevator axle devices to safely contain and control the elevator and keep it from wavering as from the building as it rotate in the main vertical rail tracks. This vertical main track system which carry the elevator from one floor to the next also connects to the horizontal rail track system by through a series of metal wheels that are contained on the inside of the horizontal tracks, by raised outer border of the horizontal tracks, as and are adapted to function in a safe manner as the elevator is driven to other different locations of the building to reach other trapped fire victims.

The motor driven exterior fire resistant elevator system having a special horizontal rail component being which is elevated at the other border a top rail that connects to the bottom rail for wheels containment, and will preferably re include an electric motor with adequate horse power and control switches for the trolley machine 20 and the elevator 22 that includes relays, clutches, transformers, sensors motion and stopping devices sufficient devices for the second power source, 2 and several parts that include trolley wheels and cable container devices along with metal lift/control metal bars 4 being approximately 6 feet long. The elevator is preferably made of aluminum steel metals for framing, flooring, sides top corners and bottom sections and welding together various parts are also suitable methods for constructing the invention.

BRIEF DESCRIPTION OF THE DRAWINGS

The present, invention provides a major break through for rescue and safety mechanisms for fireman and other first responders who must climb stairs in order to reach and rescue fire victims. The present invention will save them time and energy when they must reach areas in tall buildings with out climbing stairs with heavy equipments. Comparative advantages are set forth more particularly in the appended claims. The invention together with further objects and advantages therefore maybe best understood by reference to the following descriptions and accompanying drawings, and in which:

DETAILED DESCRIPTION OF THE DRAWINGS

Figure 1:
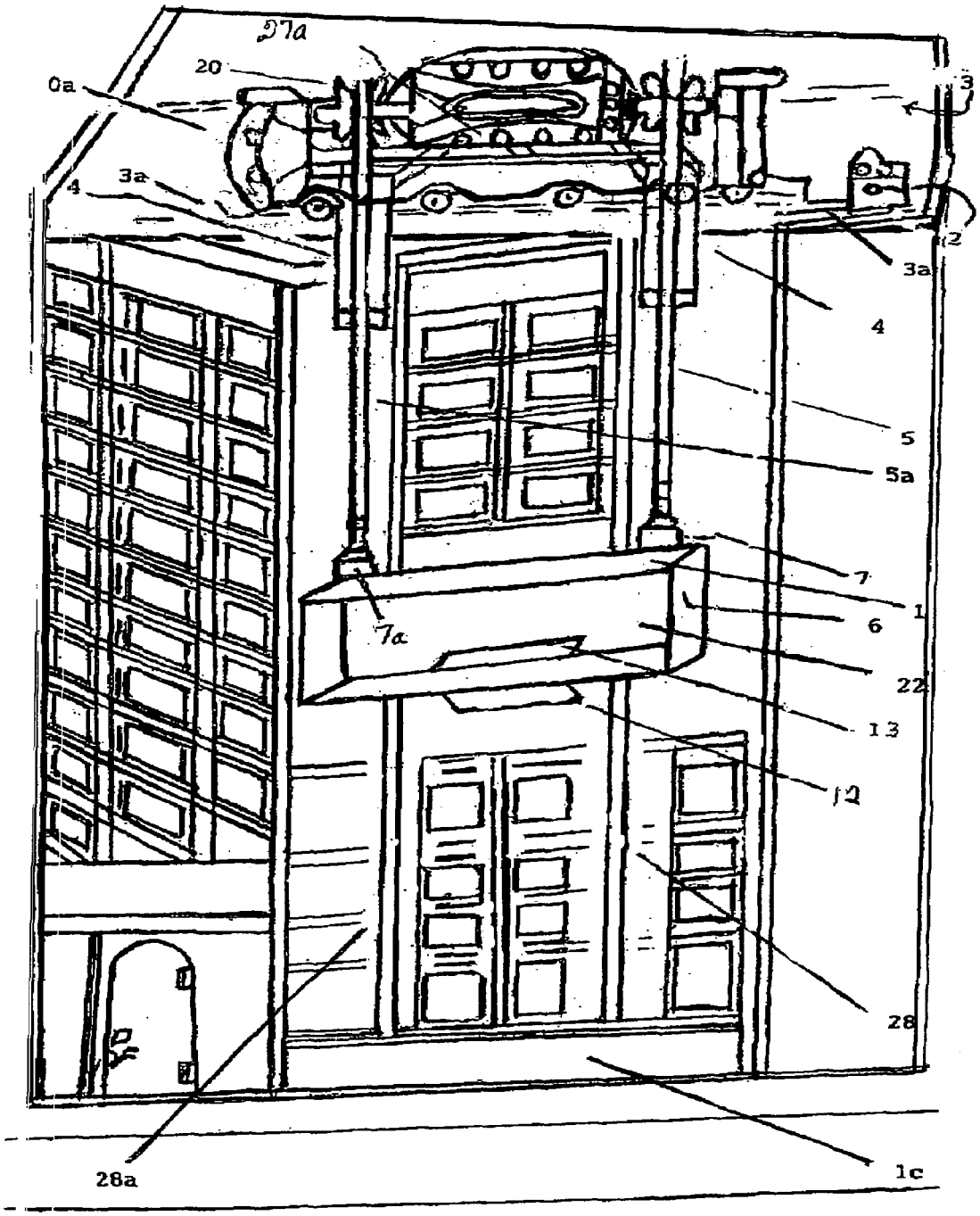
FIG. 1 set forth is an exterior fire resistant passenger elevator system having as its main component, a trolley machine car that is functional on top of buildings.
Figure 2:
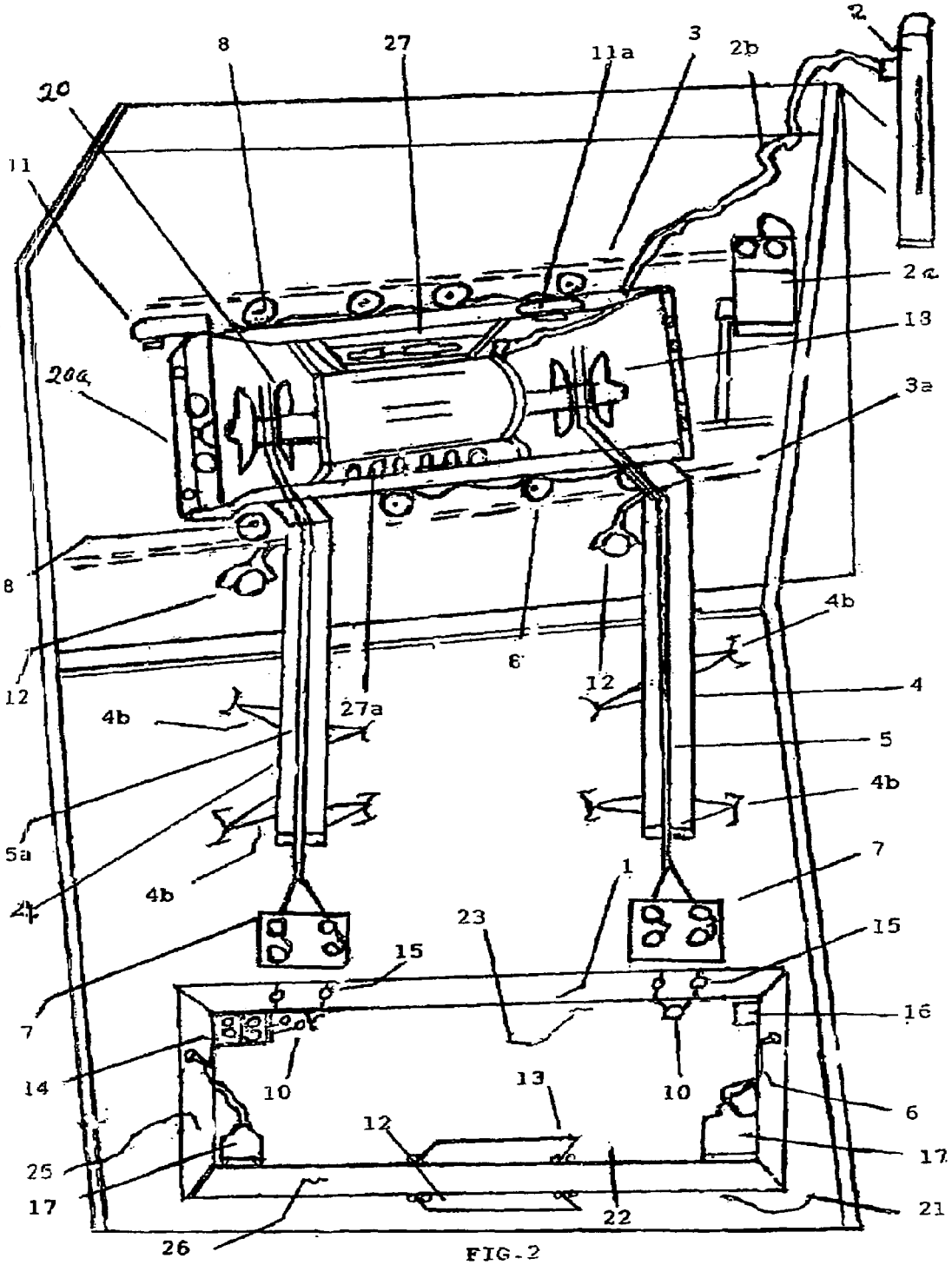
FIG. 2 is a perspective view showing an electric motor driven trolley machine car having pulley cables attached to the elevator for lifting it in vertical directions.
Figure 3:
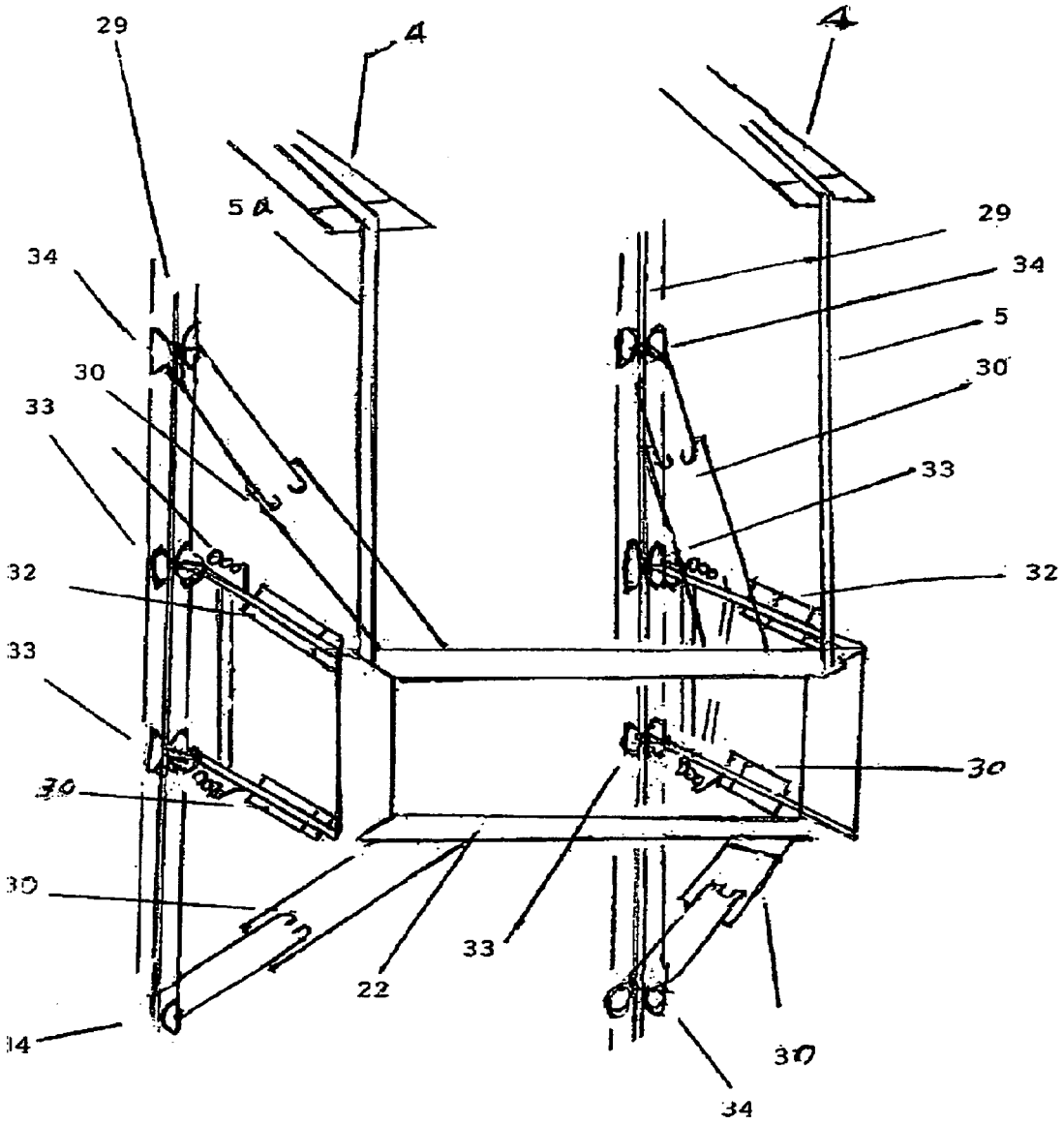
FIG. 3 is a perspective showing horizontal trolley control bars as viewed on vertical tracks that links to the elevator.
Figure 4:
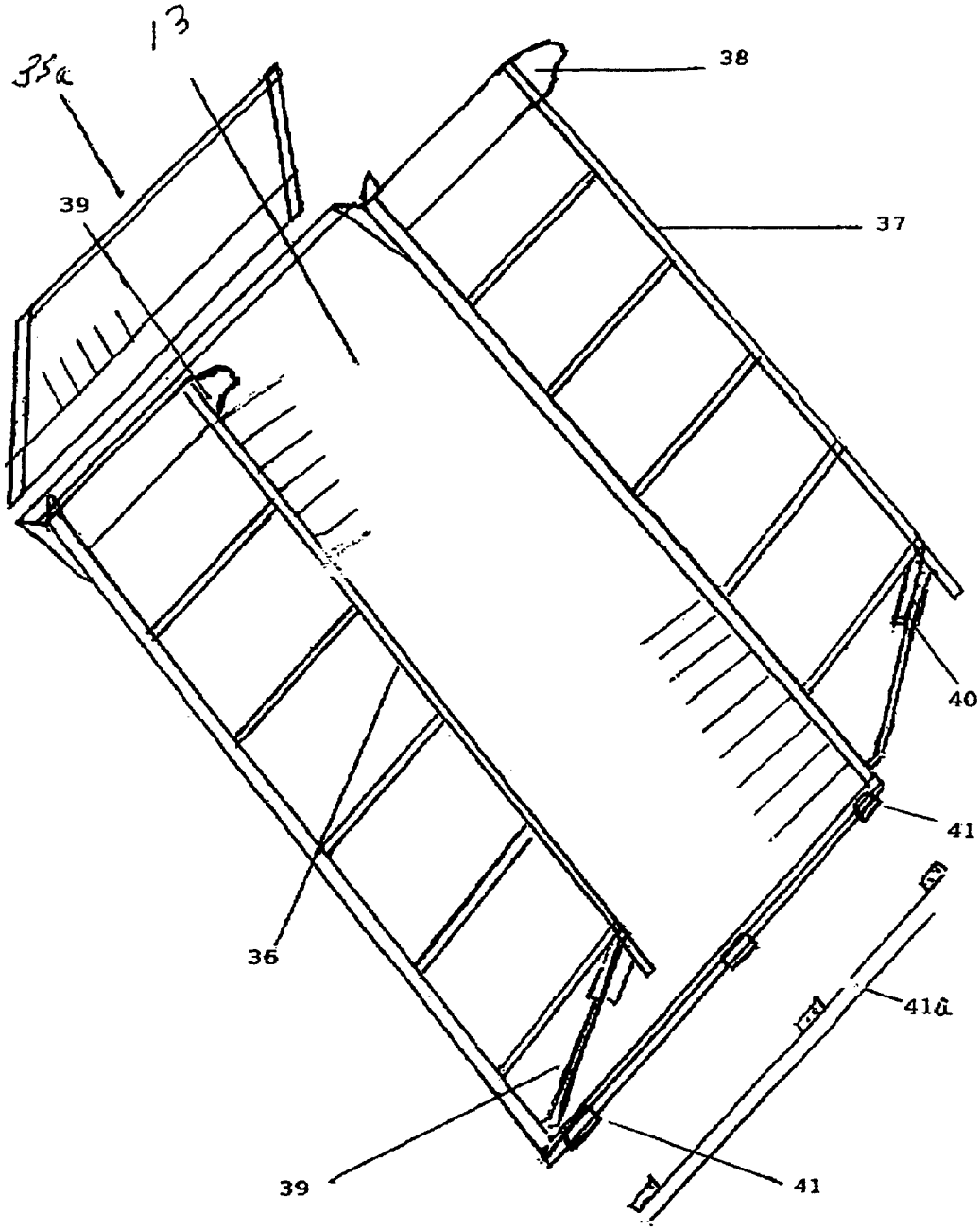
FIG. 4 set forth is a perspective showing a metal adjustable horizontal door having guard rails for passenger to hold on to as they exit buildings.
Figure 5:
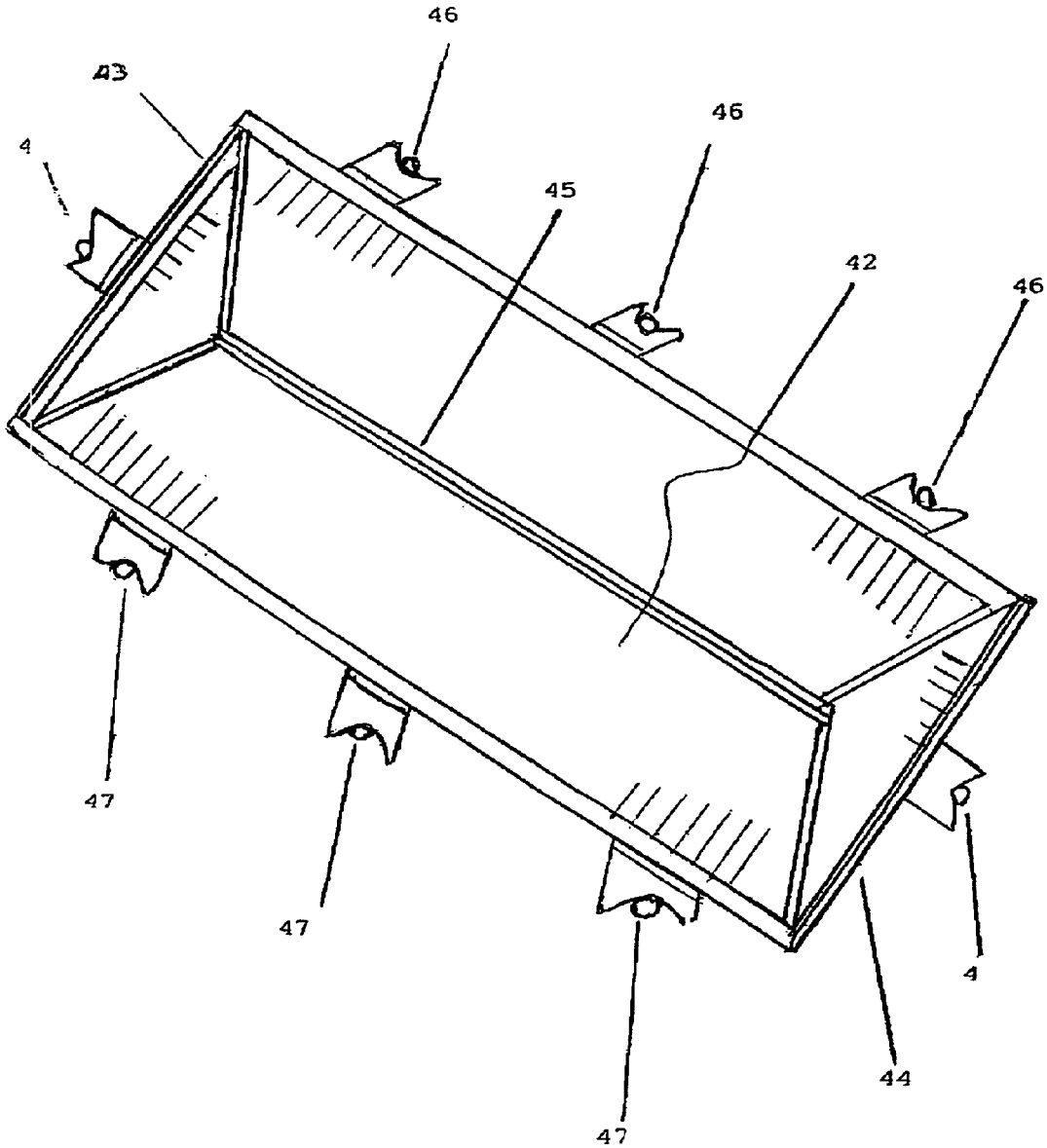
FIG. 5 is a perspective showing a slanted debris repellent elevator top for use on elevators during times when debris is falling from fires.
Figure 6:
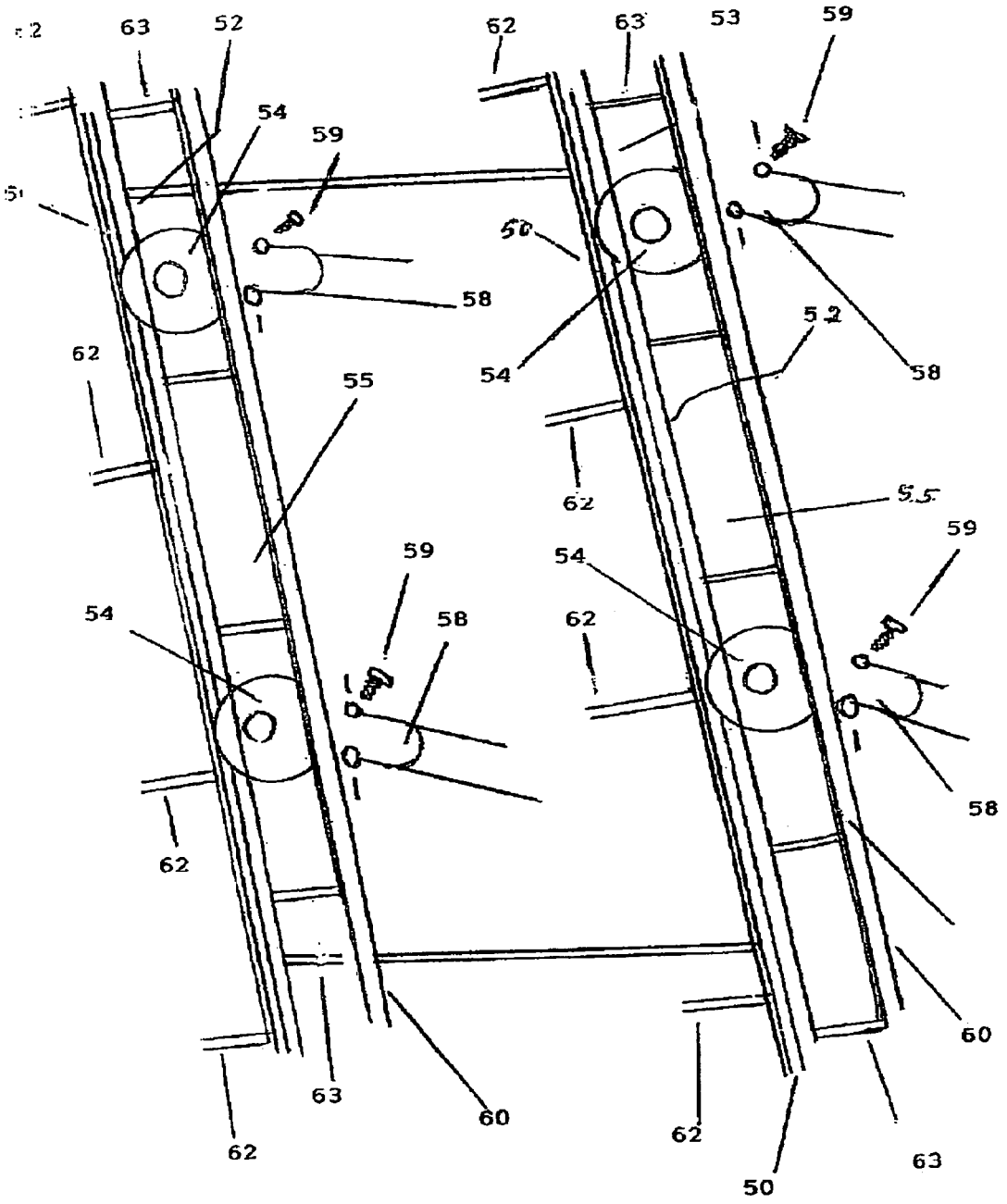
FIG. 6 is a perspective view of a steel vertical elevator tracks system consisting of a bottom and top grooves in tracks for elevator wheels.
Figure 7:
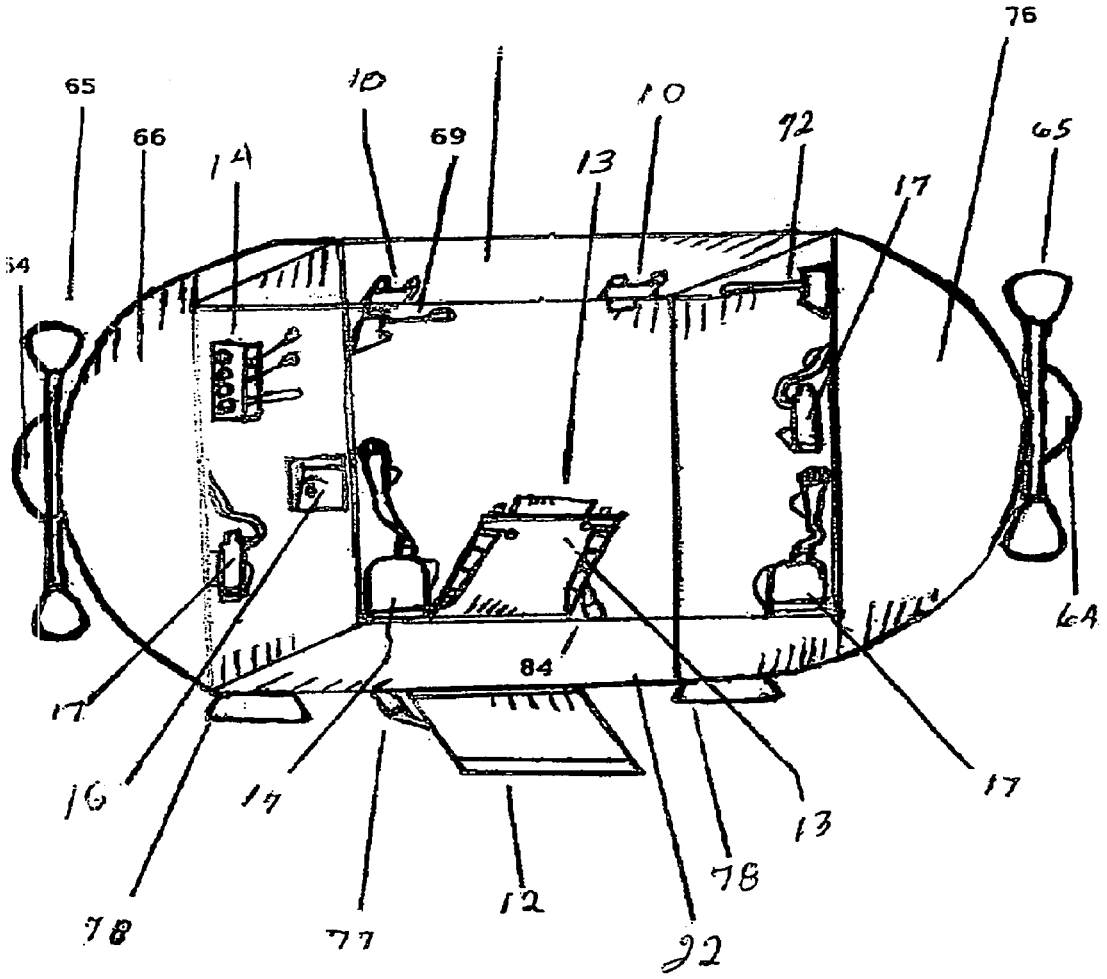
FIG. 7 is a perspective view showing a multi-purpose elevator.
Figure 8:
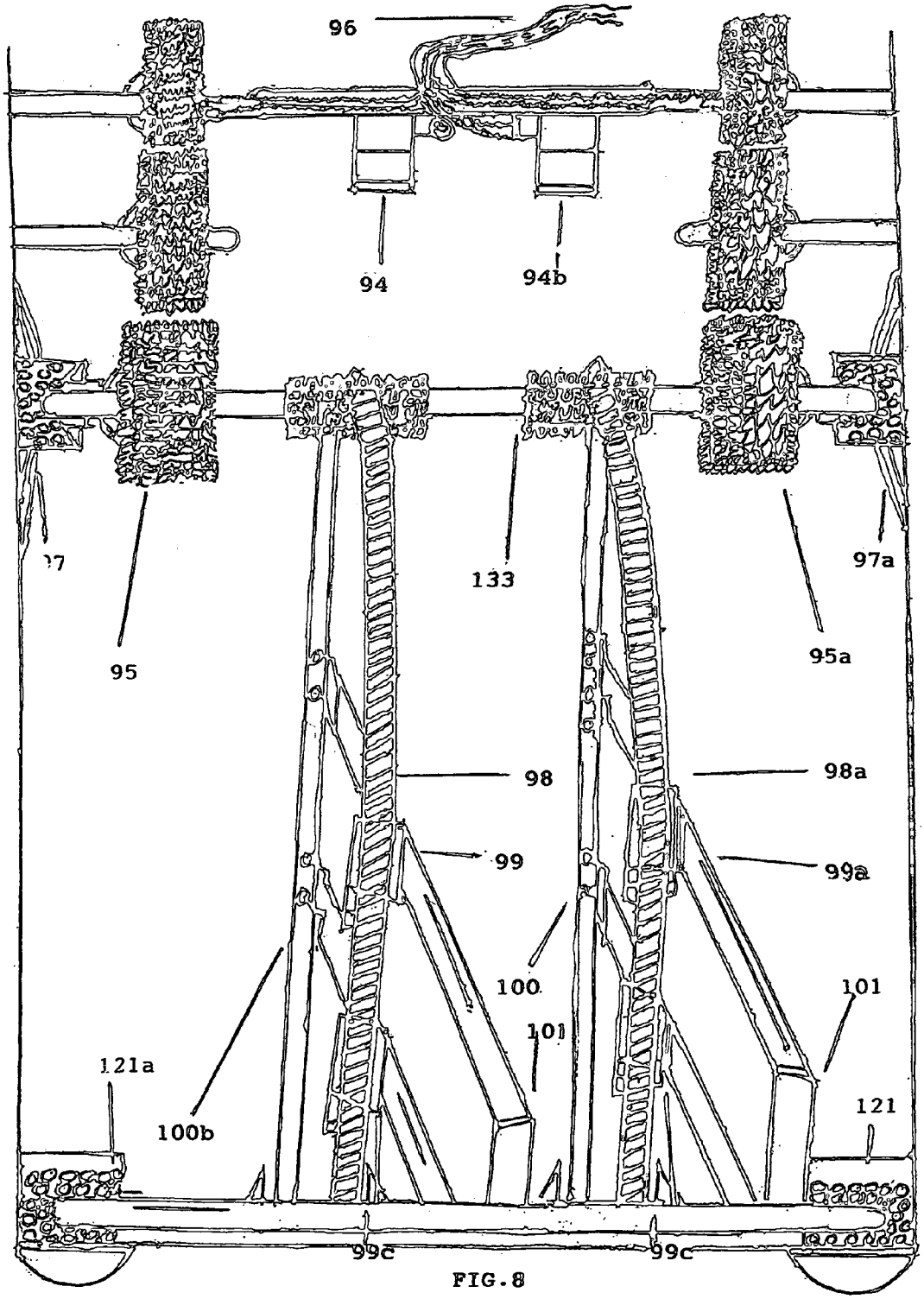
FIG. 8 is a preperative view of motors driven drive shafts that are suitable for rotating elevators in vertical directions.
Figure 9:
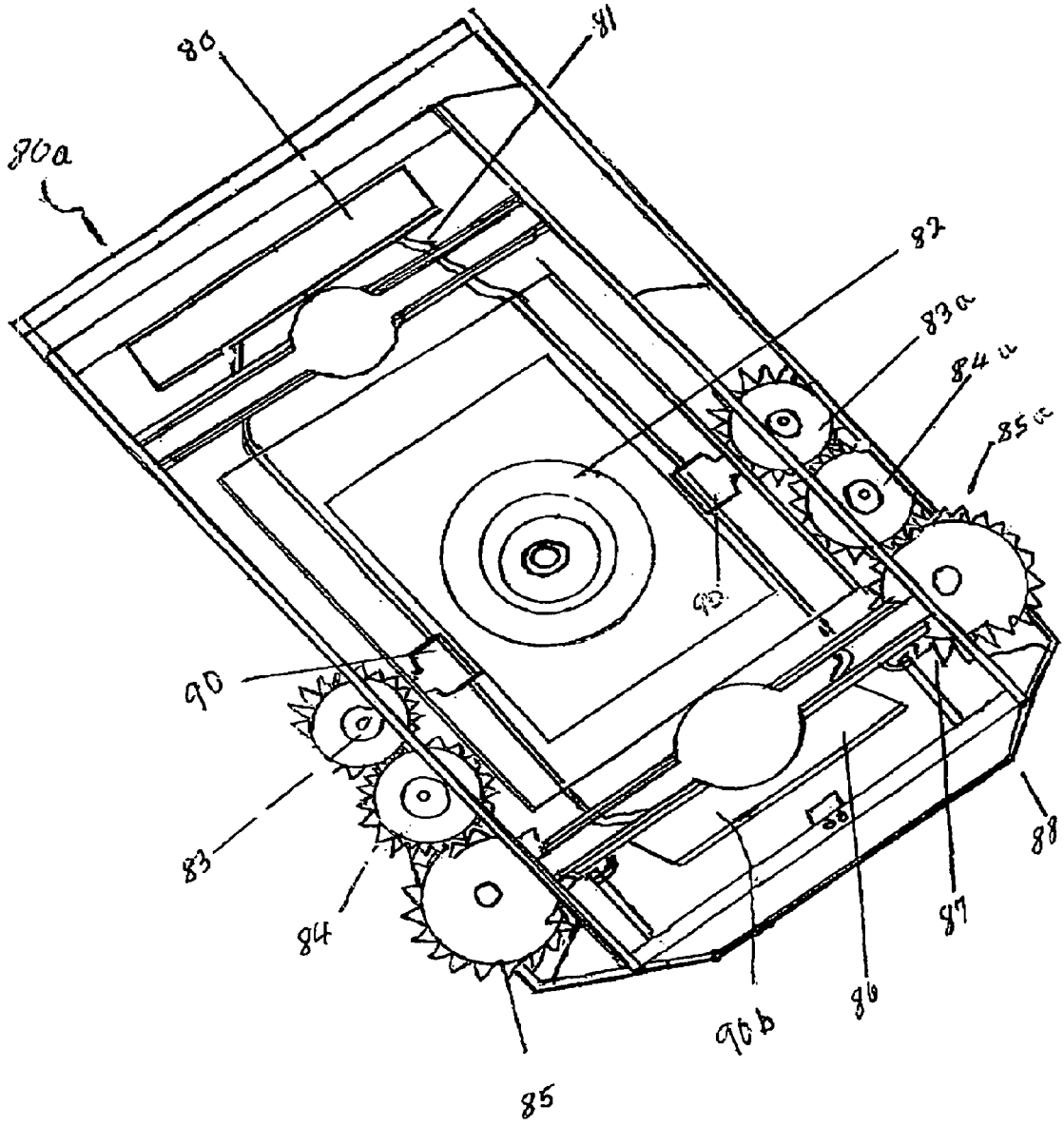
FIG. 9 is a perspective view showing a chassis for use on a trolley machine car.
Figure 10:
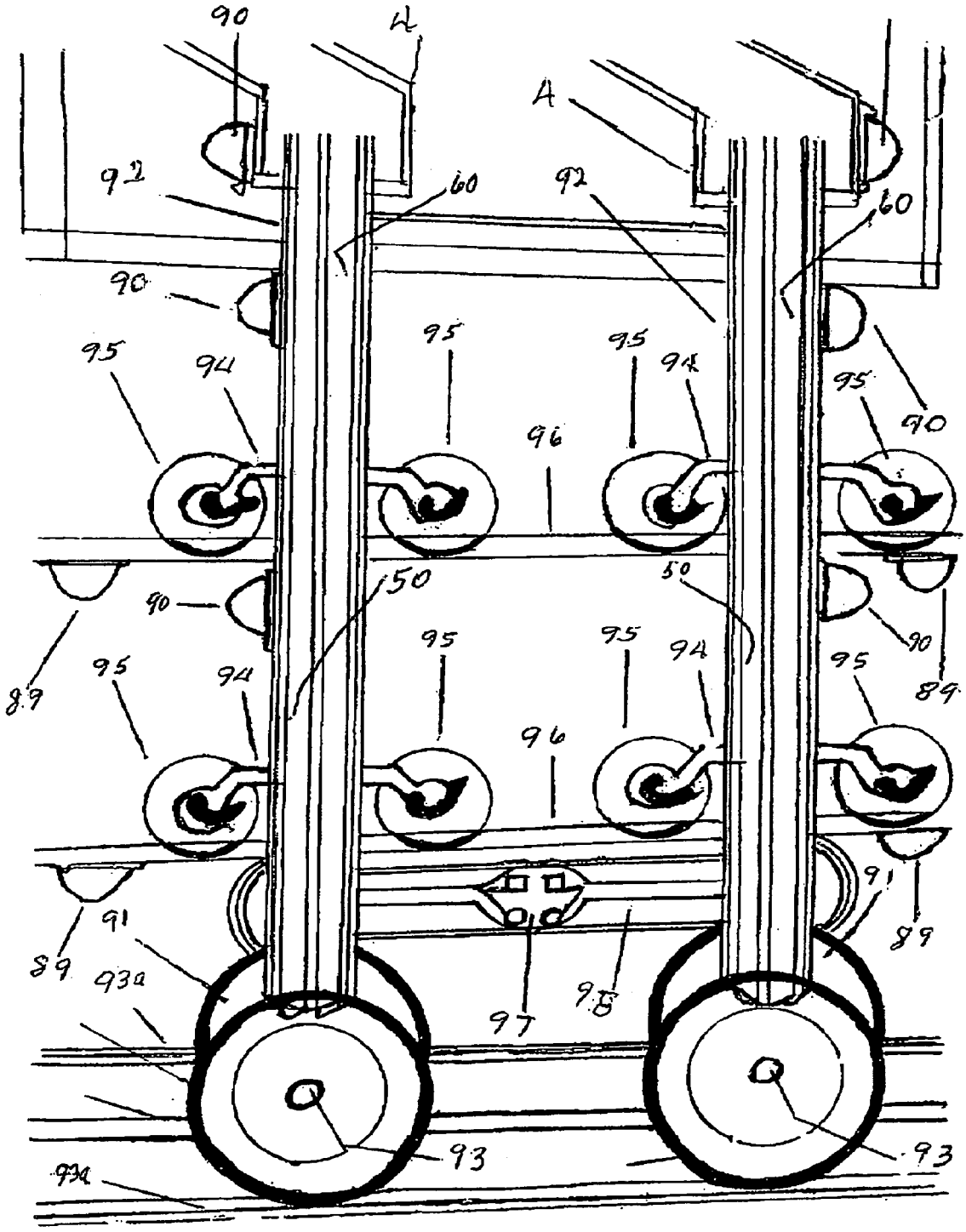
FIG. 10 is a perspective view of vertical and horizontal metal track systems adapted for maneuvering elevators on the side of buildings.
Figures 11, 12:
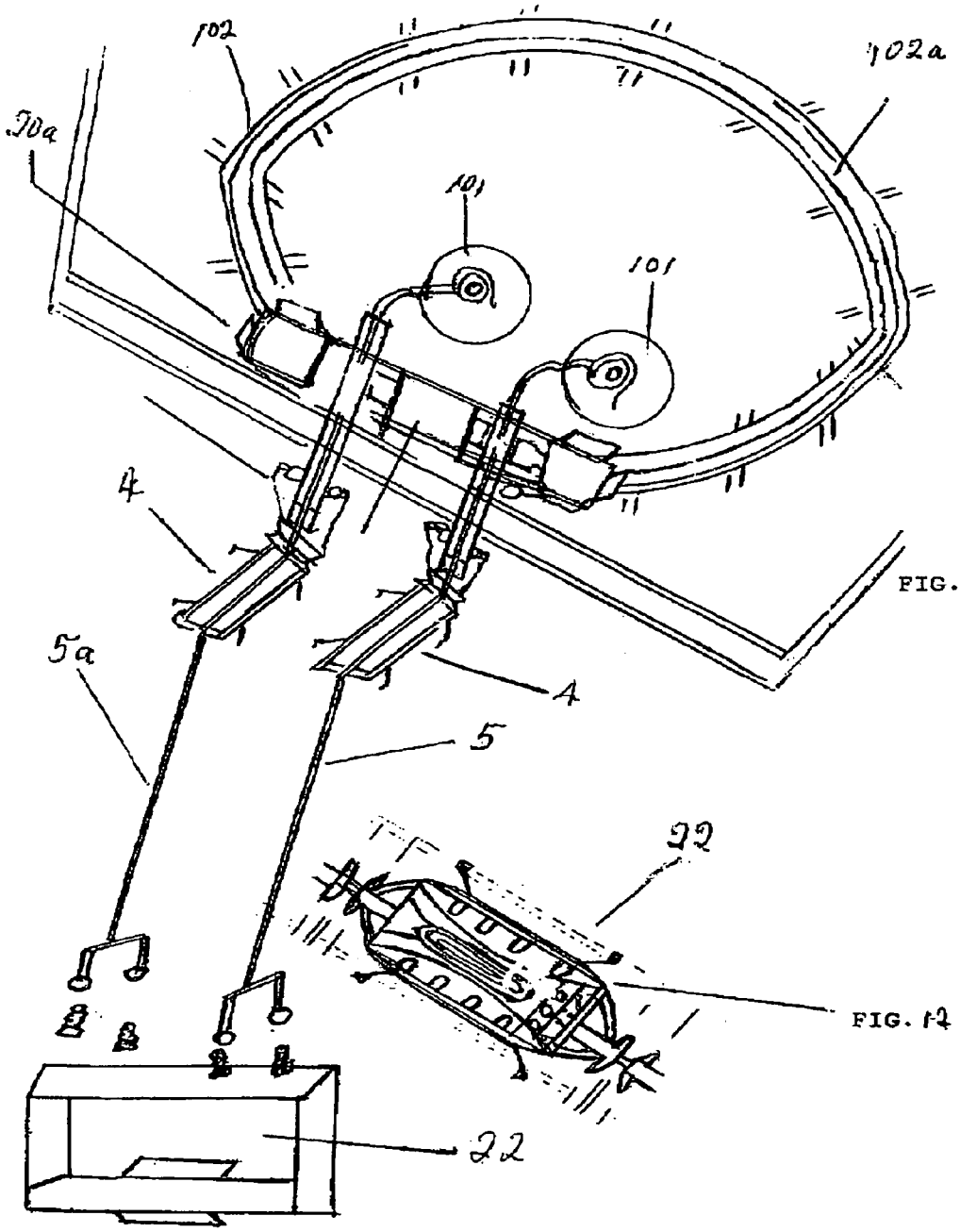
FIG. 11 is a perspective view of a roof top metal rail tracks provided for rotating trolley machine cars on the top of buildings to lift and control elevators.
FIG. 12 is a perspective view of an electric motor.
Figure 13:
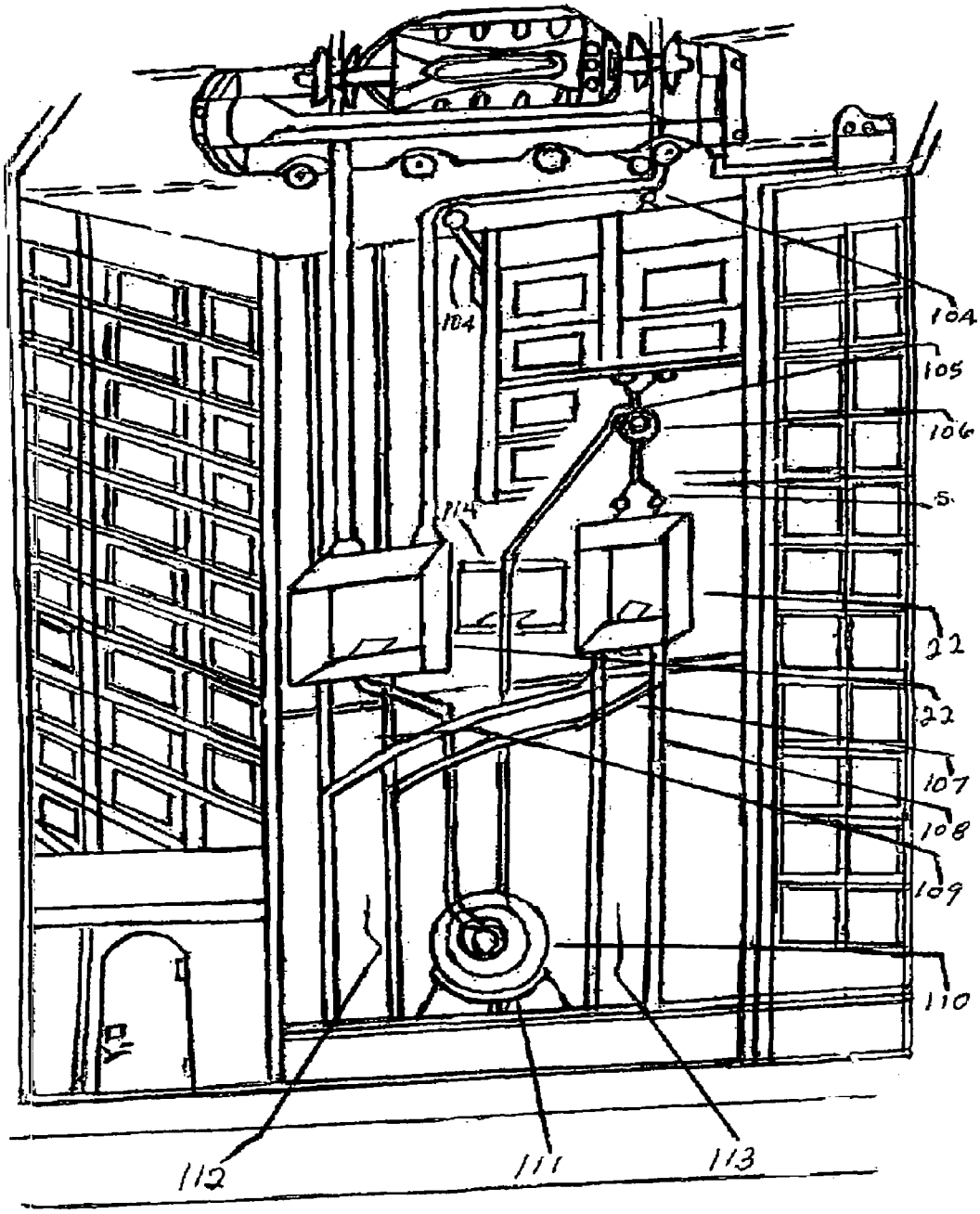
FIG. 13 is a perspective view showing a dual exterior elevator unit routes adapted for vertical distance sharing for extremely tall buildings.
Figure 14:
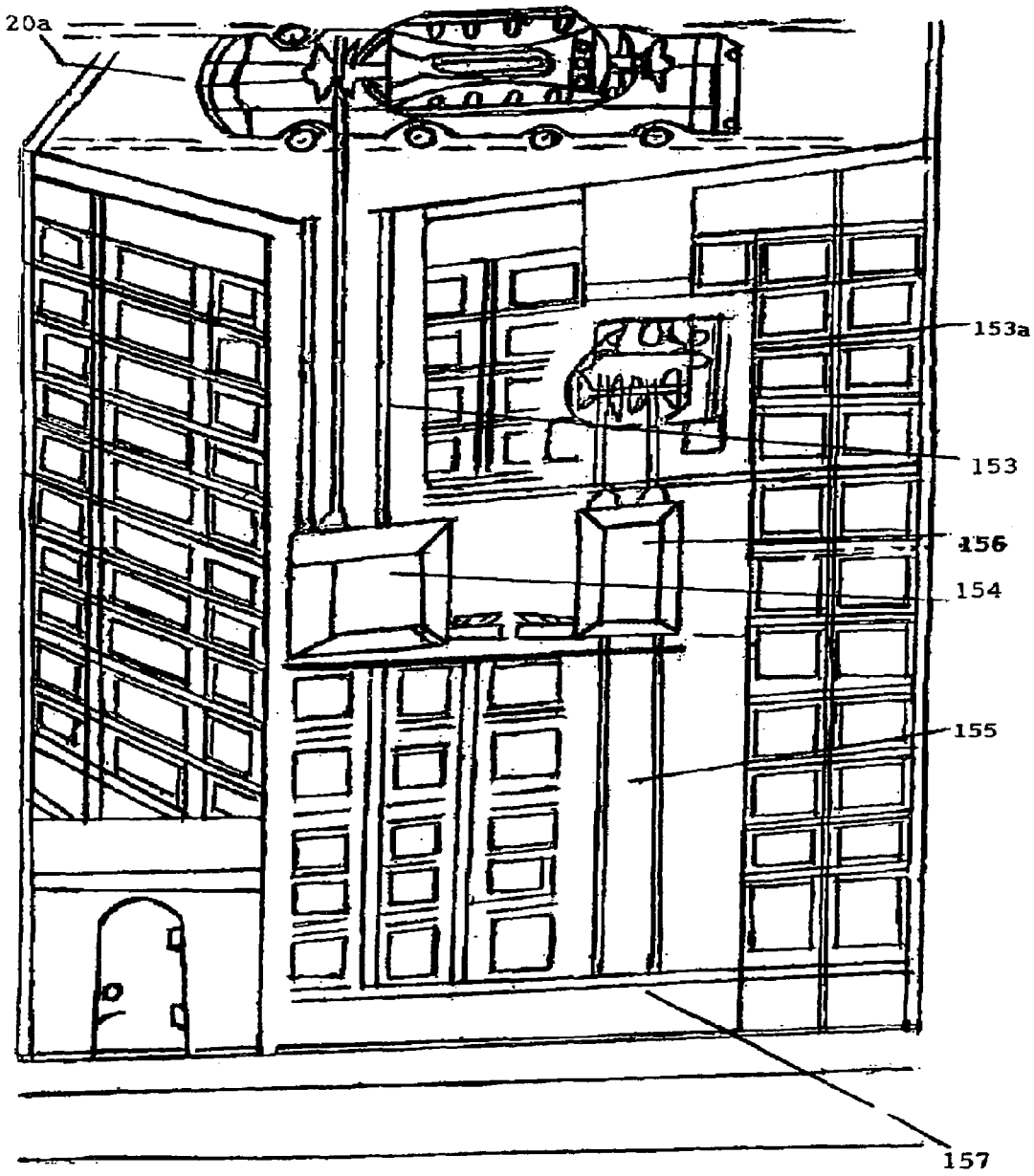
FIG. 14 is a perspective showing a single action elevation distance sharing component for vertical rotation on the exterior sides of buildings.
Figure 15:
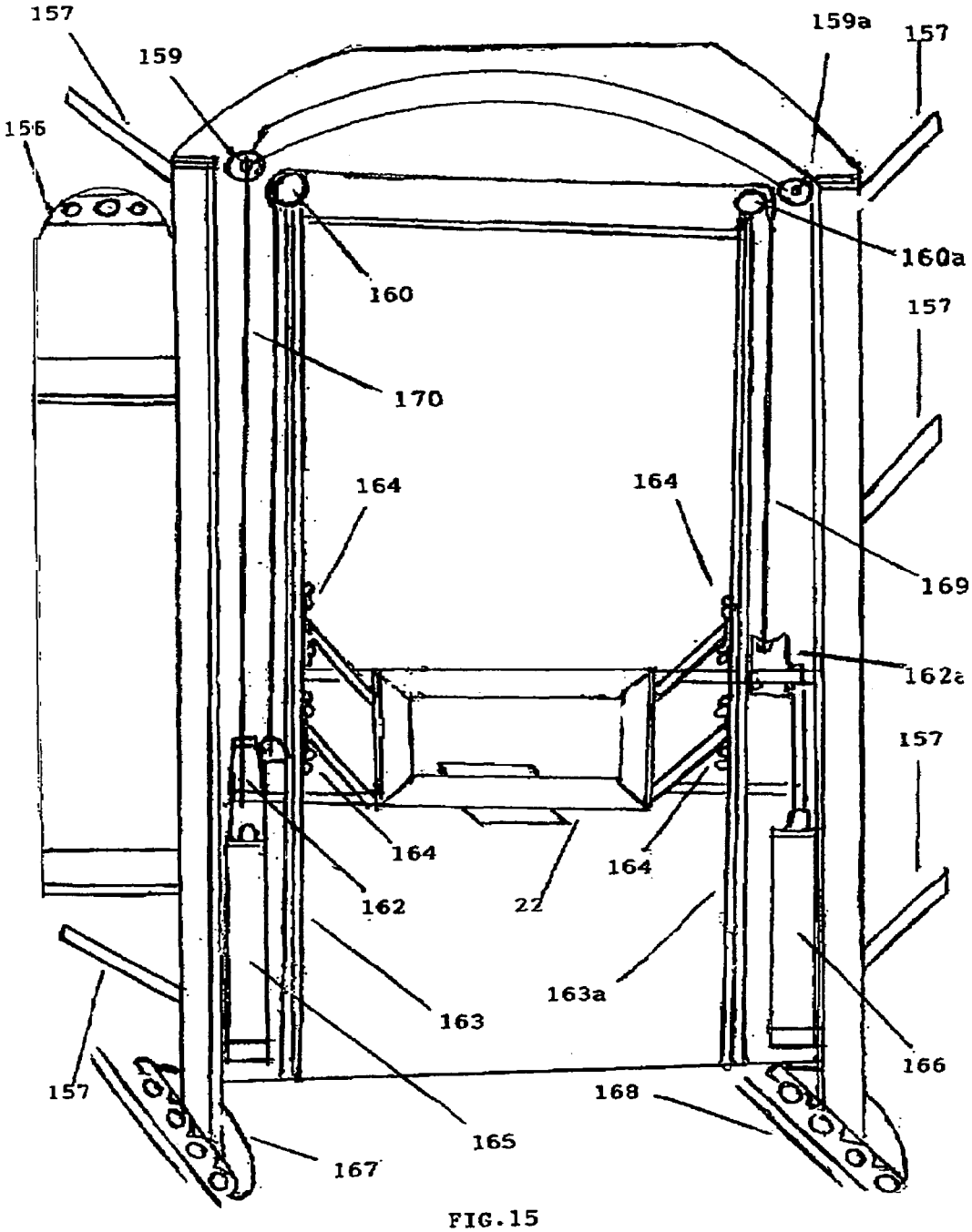
FIG. 15 is a perspective view of an elevator rotary lift device for vertical rotations.
Figure 16:
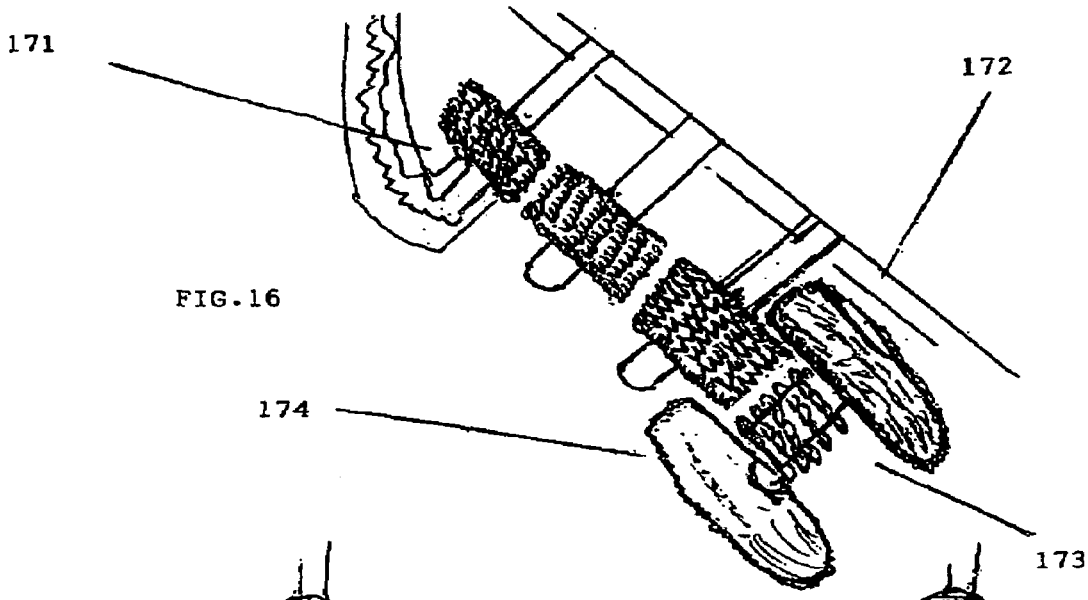
FIG. 16 is a drive shaft component for propelling the main vertical tracks horizontally around the sides of buildings.
Figure 17:
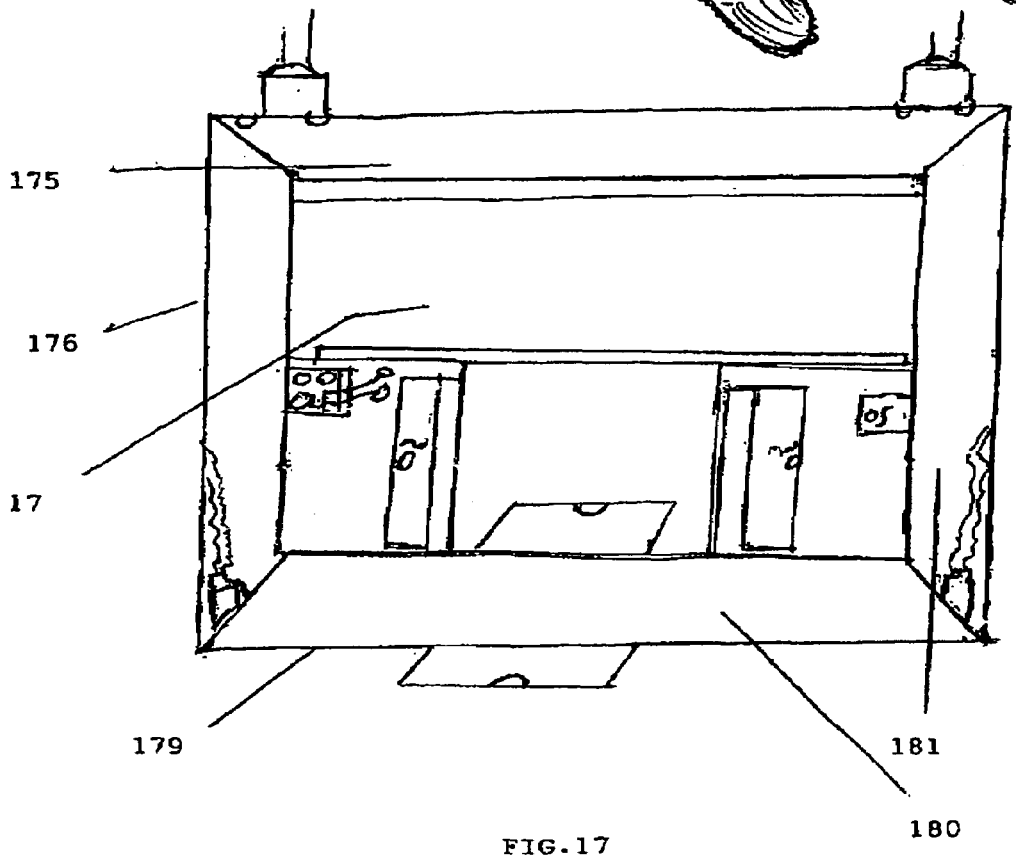
FIG. 17 is an exterior elevator consisting of a rear door and a front exit doors.

Referring now, more particularly to the drawings therein is illustrated in a more improved exterior fire resistant passenger elevator system in which: FIG. 1 is a schematic view of building 1*c* which shows an exterior first resistance resistant passenger elevation system having a trolley machine car 20*a* consisting of a flat chassis and adaptable for a steel frame, and size variations in according with building codes and other specifications. The trolley machine car rotates on metal tracks 3 and 3*a*. A large electric motor 27*a* consisting of a rotary pulley wheel device 20*b* and 20 on the left side, and a rotary pulley wheel device 20*c* on the right side of motor 15*b* for the purpose of lifting and rotating elevator 22 with cables 5 and 5*a* with control bars 4. Metal cable 5 and 5*a* having couplings connector 7 and 7*a* connect to elevator 22 which is comprised of a top side 1 and a right side 6, and is also provided with a door 12 for entering and a door of egress 13, which are adapted for vertical and horizontal positions. Control/lifting bars 4 are in a vertical position when the elevator is moving in a vertical direction, and the control/lift bars are put in a horizontal position whenever there is a need to move elevator 22 away from a building to avoid being too close to windows where fires are escaping to the outside. Vertical steel tracks 28 and 28*a* provided with a top and a bottom section tier, and having groove bottom sections with raised borders for containers wheels, and a top keeping the wheels on the inside of the double tier tracks. Materials that are preferred for constructing the invention include aluminum and steel metals, clamps, brackets metal screws and nuts bolts and metal cables. Some devices that are suitable for use are metal connecters 7 and 7*a* for joining cables 5 and 5*a* to elevator 22 by using metal nuts and bolts or by welding couplings to elevator 22 on the inside at the top horizontal sections 10 in as shown in FIG. 2. Elevator 22 consists of an operator's control section a front door 12, and a rear door 13 that are joined to elevator 22 with hinges at the bottom and a closures at the top part of doors 12 and 13. The doors are lowered and raised by drive shafts 77 and 84, as shown in FIG. 7. Elevator 22 having a top side 1, a bottom side 21, a left side 25, and a back side 23 is also provided with control switches 16 and 14, and fire extinguishers 17 and first aid kits 16 for emergency use. Processes for constructing the elevator and trolley machine care 20*a* include welding aluminum and steel exterior panels, corner bars, vertical and horizontal bars. Now, Referring to FIG. 2 is a trolley machine car 20*a* consisting of at least eight metal wheels 8 which are joined to trolley axles axle ends with lug fasteners and is also provided with a frame consisting of a motor 27*a* that is easily attached to a chassis through the process of welding, and the use of metal fasteners. Weight balances 11 and 11*a* are provided on the inside of horizontal frame line of trolley machine car 20*a* to insure that the weight of the machine car is more than enough for lifting passengers and the overall weight of elevator 22 the machine car is powered by electricity as a first source of power and a generator 2*a* is provided as a back up second power source, especially during electric power outages. Most importantly, the invention is adapted for operating on an independent electric supply line 2 and 2*b* which is separated from buildings where the exterior fire resistance passenger elevator system is located. Although the invention is adapted for size variations, chassis 80*c* and trolley machine car's frame measurements as best approximated is approximately 5 feet wide, 4 feet deep for the chassis and the length at about 12 feet long, and weight devices 11 and 11*a*. Rotary adapted pulley wheels 18 and 19 20 are made of steel products and are provided for being driven by a motor equipped with horizontal drivers for propelling pulley wheels that rotate steel cables that are attached to a vertical driven elevator system. The trolley machine car, which is rotated on metal rail tracks 3 and 3*a* is comprised with load balances 12 as stabilizers for lift/control bars 4 are connected and controlled by trolley machine car 20*a* during weight lifting and maneuvering elevator. Relays, timers, transformers and switch devices 27 are included with devices for operating the mass vertical and horizontal movements of the elevator. Elevator 22 consisting of cables 5 and 5*a* is also comprised with clamps 4 and 4*b* which are joined to elevator control and transfer bars that are adapted for clamping onto an elevator during periods when it is being transferred to a different side of the buildings. Trolley machine car 20*a* is adapted for transferring the elevator by lifting the elevator onto transfer bars 4 and maneuvering clamps 4*b* for attaching onto the elevator and then lifting the elevator vertically onto the top sections of trolley machine car 20*a* for transfer to another location. Shown again is elevator 22 having an operator control section 14, a first aid kit 16, a front door 12 and a rear door 13, and the elevator is also provided with fire extinguishers 17. Shown in FIG. 2 is elevator 22 consisting of a front side 21, a back side 2, a left side 25 and a right side 6 and bottom side 2, and the elevator is attached to metal cables 5 and 5*a* with brackets 10 with metal fasteners. Referring to FIG. 3 is a perspective showing elevator 22 which comprises axles 32 that are joined to the inner side of the elevator as shown and each axle pivots horizontally to the a wheel or bearing laden slide devices and connecting to the wheels 33 of which are adapted for rotating on the main vertical rail tracks 29. A second set of axles 30 and 31 having hydraulic features, are slanted to an approximately 30 degree angle from the bottom side of elevator 22, and extend inward to the main elevator tracks 29 connecting to wheels 33 for keeping elevator 22 at a fix position in order to regulate and adjust motion within the elevator as it carry passengers, and for extending and regressing elevator 22 in tandem with trolley machine car movements away from a building. Further, set forth in FIG. 3 are lift/control bars 28 which are connected to trolley machine car 20*a*, and is adapted for maneuvering vertically and horizontally as directed by a programmer or by trolley machine car operators. Cables 5 and 5*a*, having vertical lines connecting lift/control bars 28 to elevator 22, and to be more precise, cables devices 5 and 5*a* are adapted with enough strength to safely handle the weight of the elevator and it' content contents. Double tier elevator tracks 29 are adapted for keeping the elevator at a safe distance from fire "hot spot" in buildings with hydraulic axles that are adapted for retracting to move the elevator with wheels components are inserted onto tracks 29. Hence, FIG. 3 is an invention comprising of different component devices including an elevator component that is adapted for drive shaft devices that are capable of rotating elevator wheels 34 by having a vertical connection to horizontal axles that extend inward from the elevator and are joined to the center sections of wheels 54 as shown in FIG. 6 for rotating on the main vertical tracks. Electric motors and component devices receive electricity directly from an electrical supply line as seen at sections 2 and 2*b* in FIG. 2 which is provided for trolley machine car 20*a*, and also is provided for transmitting electric current to drive shafts, rail tracks and other electric components including wires and for electrically connecting various parts to elevator 22, and other devices according to the invention including drive shafts as shown in FIGS. 13 and 17 devices 32 and 32*b* are also suitable for providing rotary function in various modes for elevator 22 in tandem with the cable driven components or independently from the cable drive which function through a series of devices that include timers, relays, switches monitors, transformers, and clutches. Materials suitable for constructing the present invention include aluminum and steel metals, metal wheels for trolley machine car 20*a* which is adapted for progressing on metal wheels. The movements of elevator 22 on vertical tracks are made safe because of metal wheels being enclosed between double tier vertical tracks as seen in FIG. 3 and FIG. 9. Drive shafts, wires, nuts and bolts, screws, relays, control switches, sensors, transformers and timing devices are included in parts and products are used for constructing the systems. Referring to FIG. 4 is an inside transfer door 13 in elevator 22, and is shown in a lowered horizontal position providing a way for transferring passengers across door 13 which is also adapted for extending from elevator 22 to windows of buildings for from a buildings providing ways for fire fighters to cross from elevator 22 to a window in a building or to permit fire victims to exit a building and enter elevator 22. Aluminum steel guard railings 36 and 37 adapted to locks into upright positions whenever it is lower to a window by hydraulic lifting devices as shown in FIG. 15 for protecting passengers when they use the door for transfer. Door 13 is comprised with a floor level 35, window plate 35*a* which is appropriate for extending to the inside of a window to serve as a step ladder for passengers to climb through windows to reach door 13 for crossing over to elevator 22. Provided are metal railing posts 38 and 39 for passengers to grasp as they exit a building for crossing over to elevator 22. Elevator door 13 is provided with hydraulic lifts 39 and 40 for opening and closing door 12 and 13, and metal hinges 41 are provided for joining door 13 to the floor level of elevator 22 border bar 41*a* with metal fasteners. Referring to FIG. 5 is a slanted metal elevator top 42 that provided for the elevator 22: it comprises a left side 43 and a right side 44, and is equipped with metal closures 46 and 47. The v-shaped steel elevator top 42 having a steel top is slanted from the top center 45 to allow falling debris to slide off instead of overloading an elevator with added weight. Now, Referring to FIG. 6 are dual tier main steel elevator tracks 52 and 53, consisting of grooves in the middle parts of both tracks, are joined together with metal bolts 63, and include elevated borders about 3 inches high on each side of center grooves sections of tracks 50 to approximately 3 inches, and thereby providing an overlap or partial closure of the outer tracks of top track 53 and bottom section 50. The main vertical tracks, comprising a top tier 60 at the left side track and a top tier 60 for the right side track, and each top rail structure is comprised of an overlap or border closure 60*a* for the left side and 60*b* for the right side as devices for containing steel wheels 54 safely inside of the double tier main track systems. Steel bolts 62 as shown in FIG. 6 are intended for joining 52 and 53 with long steel bolts by inserting the bolts into steel beams of buildings from the exterior side of walls by first locating beam columns within buildings up the route on the same vertical line of the tracks system and attaching sections 62 to steel columns within the building. The top tier track 60 and bottom tier track components 50, encloses elevator wheels 54 as shown in sections 55 which separate the top tier and bottom tier layers with partial opening 55 and 57 for providing space for connecting the elevator axle with steel couplings 58 by inserting double pronged steel couplings 58 over top tier 60 and joining them to wheel sections 54 with metal bolts, and then, by inserting bolts 63 and 59 into bottom tier 50 in the border areas, and thereby providing a clear pass for the wheels to roll. Materials that are suitable for constructing the main tracks include aluminum and steel metals, and plastic for enclosing various track designs and exterior sections of the double tier vertical track system and the horizontal track system shown in FIG. 10. Referring to FIG. 7 is an exterior fire resistant passenger elevator 22 which comprises an interior metal door 13, a front or exterior door 12, and is also comprised with closures 84 hydraulic lifters 77 and 84 as shown in FIG. 7, and monitoring search lights 65 and rotary blinking lights 64, and are adapted to activated in tandem with search lights 65 and as directed by the system programmers or by the elevator operator, and also provided are aluminum or plastic light fixtures for complimenting elevator 22 of which is further consisted with an operator control section 14. Fire fighting devices including axes 69 and 72. Comprised also are fire extinguishers. Elevator 22 having a first aid kit 16, a cone-shaped left end 66 and a right end 76 is also provided with a front door 12 and a left door 13 that are attached to the elevator with metal hinges. Also provided are elevator landing pillows 78 which are generally joined to the bottom side of elevator 22 through a process of welding. For at least 4 vertical 8 feet corner flat frame braces four 2 inches in diameter flat horizontal frame braces approximately 12 feet long, four 2 inch in diameter cone shaped frame ends 66 and 76 for closing the left and right sides of elevator 22. Referring to FIG. 8 are drive shafts 70*a* consisting of left side drive shafts with wheels 68*a*, 69*a*, and right side drive shaft 70*a* with wheels 68, 69, and both drive are provided with the primary pulling wheels 70 which are powered by electric motors 20 to rotate metal cable lines 5 and 5*a* and to propel elevator 22. Referring to FIG. 9 is a trolley chassis 88 comprising a front end 80*a* and a rear-power plant 90*b* is adapted for front end 80*a*, and front 80 devices that include an axle for metal wheels, steering, electrical power and brake that are provided for system wide distribution control by trolley machine car distributions for the system including motors and drive shaft that receives electric currents through a series of wires 81 that connects at front end power section 80. Steel and aluminum materials are preferred for wheels, frame, drive shafts and axles. Relays, switches, monitors, timers, clutches washers and fasteners and trolley machine connectors are among items preferred. Chassis is provided with a left side drive shaft consisting of wheels 83, 84 and 85 and right side drive shaft consisting of wheels 83*a*, 84*a* and 85*a*, and both drive which are generally attached to wall of the chassis are powered by electric motors 90 which are provided with a left side drive shaft, consisting of wheels 83, 84, and 85, and is also provided with a right side drive shaft consisting of wheels 83, 84, and 85. Both left and right side drive shafts are powered by electric motors 90. Referring to FIG. 10 is a vertical main track system provided for propelling an elevator in vertical directions, and consisting of a horizontally multi-rail track components 96 which are adapted for supporting wheels 95 which are connected to horizontal axle arms 94 which are generally welded to main tracks 92 for rotating elevator. Trolley machine car 20*a* is the central source for providing electric power that to the heavy vertical main track system 92 for movements in horizontal directions. Now, Referring again to FIG. 10 are main vertical tracks 92, having vertical and horizontal functions with ground level connections to metal wheels 91 that are adaptable for rubber base and are rotated on metal tracks 91 are attached to main tracks 92 with metal lugs or the like. Electric wires, metal cable chains, nuts bolts, pipes, brackets, relays, monitors and timers, are among the products that are suitable for constructing the rotary/lifting component in the invention. Referring to FIG. 10 is a vertical, main track system having a horizontally multi-rail track component 96. The vertical track function connects to the rooftop trolley car 20*a*, and connecting to lift/control units 4 and with ground or base level connections to metal wheels 91 that are attached to axles and connects to metal lugs and washers. Motors and drive shafts 97 and 98 propels wheels 91 in tandem with trolley machine car. Timers and switch control area 98 that is programmed to trigger wheels 91 movements across ground level tracks 93*a* and in tandem with system's operator of trolley machine car 20*a* trolley machine car 20*a* is powered by an electric motor, and comprises gears, timers and switches. The flat rotary lifters 4 are approximately 6 inches in diameter and 12 feet in length, and are preferably suited for manipulating lifters which are preferably designed to be approximately 12 feet wide, 6 inches deep and eight feet long, and having a center tunnel to be used as cable containers, as cables 5 and 5*a* are manipulated from cable storing wheel devices 101, and providing cable extensions for elevator 22, as it is maneuvered by an operator. Referring to FIG. 12 is an electric motor that is provided with adequate horsepower to operate the exterior fire resistance passenger elevator system. The invention is adapted to comply with additional guidelines including codes that may be set forth by governmental regulations and structural designs. The rooftop rail track system is preferably installed in accordance with building and code specifications, and in other word, safety consideration is all-ways involved as steel tracks and heavy machinery are installed, especially on roof-tops. Referring to FIG. 13 is a trolley machine car 22 that is erected on the rooftop of building and consists of an electric motor 20 which rotate metal cables 5 and 5*a* on a vertical plane with cable support lifters 5 and 5*a* as they lift elevator 22 on a vertical line from a half-way section of buildings to the top of the building in tandem movement of elevator 22, and at the bottom is depicted also is a trolley machine car 22 that is powered by electric motors that comprises gears, timers and switches for cable controls 135 and 135*a*, and rotary/lifting devices 134 and 1340. Referring to FIG. 12 is an electric motor that is provided with adequate horse-power to operate the exterior fire resistant passenger elevator system. The invention is adapted to comply with additional guidelines including codes that may be set forth by governmental regulations and structural designs. Rooftop rail track system 102 is preferably joined to the roof in accordance with building and code specifications. In other word, safety consideration is always involved as steel tracks and heavy machinery are installed, especially on roof-tips. Referring to FIG. 13 is a trolley machine car 20*a* on the rooftop of a building consisting of rotating metal cables 5 and on a vertical plane over cable support devices and 5*a* as they lift elevator 22 on a vertical line from a half-way section of the buildings to the top of it in tandem with vertical and horizontal movement of elevator 22 to the bottom of the main track system 92 and across a horizontal track system 96 consisting of dual metal wheel components 95 having steel bracket connection 94 to main tracks 102. The horizontal tracks 128 having tracks and exterior wall connection are also comprised with raised borders 132 for safely containing horizontal wheel movements. The invention provides adapted for adequate track devices to include most building's exterior dimensions; it is also provided with vertical rotary and spotlights devices 131, and horizontal lights 129 aJ:'e provided with blinker devices. The mobile track system is preferably identical to the main vertical track system as seen in FIG. 6. The horizontal tracks being solid steel are preferably in sections of approximately 12 feet long, about 2 inches wide and 10 inches deep and comprising an elevated outer border being approximately 3 inches high to contain the wheels 105 inside as they are rotated. Tracks 128 being solid steel are suitable for attaching each rail section to metal joists from the exterior side of buildings. Welding, nuts and bolts, brackets, lugs/nuts, metal wheels being approximately 4 feet in diameter and timers, electric motor, control switches and relay devices are among items that are suitable for constructing the mobile track system. Referring to FIG. 11 is a perspective view showing a metal track component 102 to the invention; set forth is a circular steel track device that is suitable for connecting on rooftops of most high-rise buildings. Depicted also is a trolley machine car 20*a* that is powered by electric motors and is provided with gears, timers monitors and switch control for rotary movements and for lifting and maneuvering the rotary control lifters 4 of which are approximately 6 inches in diameter and about 12 feet in length, and are adaptable for changes to comply with some codes and specifications requirements. Cables 5 and 5*a* are manipulated from cable drive and cable extensions areas 101, which are used for storing cables onto revolving wheels for used as needed. Shown in FIG. 11 is elevator 22 as an illustration of it's function with the roof top rail system 102. The diagram of track system 102 depicts how trolley machine car 20*a* is rotated around tracks 102*a* as metal tracks 102 are joined to small rail tires with metal fasteners. Now, Referring to FIG. 12 is an electric motor 20 that is provided with adequate power to operate the exterior fire resistant passenger elevator system. The invention is adapted to comply with additional guildlines including codes that may be set forth by governmental regulations and structural design. Roof top rail track system is preferably attached to the roof in accordance with building and code specifications. In other words, safety consideration is all ways involved as steel tracks and heavy machinery are erected, especially on roof tops. Referring to FIG. 13 is a trolley machine car 20*a* on the roof top of a building consisting of an electric motor 20 which rotates metal cables 5 and 5*a* on a vertical plane over cable support lifters and as they lift elevator 22 on a vertical line from a half way section of buildings to the top of it in tandem with horizontal movements of elevator 22 to the bottom or ground level of buildings. The wheels based elevator is suitable for maneuvering by trolley machine car 20*a* down rail tracks 107 as elevator 22 is maneuvered in tandem down tracks 109 leading to the ground level. Elevator is pulled by cable connected to coupling unit of 150*b* that revolves around pulley wheel device 151 and upward to pulley wheel connection 143 and 144 and being joined to elevator couplings 156. Referring to FIG. 14 is trolley machine car 20*a* as shown on roof top building 157 111. Depicted are dual designs that provide for distance sharing by more than one elevator. The first elevator 22 on the left side covers transport route on tracks 112 to upper floors and delivering passengers to transfer area that connects to lower tracks 108 where fire victims can board elevator 22 on the right side for transfer to the ground level. Both elevator are adapted to function independently of each other. Referring to FIG. 15 is an exterior rotary elevator that is erected in close proximity to buildings by using metal flat rod connecters being 157 approximately 10 feet long and 3 inches in diameter to be 3 feet from buildings with the remainder 7 feet being attached to the left and right sides of rotary frame. Electric motor 156 activates pumping unit through relays and timing devices that feed current to hydraulic rotary lift devices 162 and 162*a* for vertical movements of elevator 22. Cable 169 connect hydraulic lifts and elevator connecters 164 rotates over corner pulley wheels 160 and 160*a* in a clock/counter clock direction as similar motion and 160*a* in a clock/counter clock direction in facilitating lifting mechanisms in hydraulic lifter 162 as it pulls cable component 170 over corner pulley wheels 159 and 159*a*. Rotary unit 158 comprising rotary slide bars are connecters for elevator 22 and there by provide for elevator side attachments 164 by using metal nuts and bolts or by welding together the various sections of the elevator connecters. Elevator 22 is suited for routing inside of vertical side bars 163 and 163*a*. The rotary unit 158 comprised with heavy duty steel rollers 167 and 168 is also provided with unit bar connecters 157 for attachment to buildings. The rotary lifting unit 158 is adapted for adjustment and variations in accordance to code specifications and government regulations. The frame is preferably constructed from steel exterior beams being approximately 3 inches thick and 12 inches wide and being section bars should be approximately 2 inches thick, 8 inches wide with a length of 15 feet. Electric motors, hydraulic lifting devices, pumps, small corner wheels, metal cables, rotary base wheel devices, aluminum and steel sheets and wiring are among the materials needed for construction. Relays, timers, control switches, couplings, and brackets are among other devices that are suitable for use in the constructing process. Now, Referring to FIG. 16 is a drive shaft comprising a three wheels combination device being suitable for mobile drive for the main vertical rail track system FIG. 10 which comprises an electrical power unit that is capable of receiving relay signals from trolley machine car 20*a* that requires mobile movement in tandem with the exterior fire resistant passenger elevator system to other locations as directed by programmers or the elevator operator. Axle drive devices 173 is preferably installed between wheel combinations 172 and 174 or all system's rail tracks mobile units; other drive shaft which are suitable for drive components in other sections of the exterior rail track system; and Referring to FIG. 17 is an exterior fire resistant elevator compromising a top side 175, a bottom side, 180, a left side 176 and a right side 181, and included is a front side 179 and 177 having interior midpoints designed providing rear or interior opening that will provide an elevator side 177 and thereby providing features that allow firemen to attack fires and maintenance workers to do exterior repairs and wash windows while standing on the inside of an elevator.

What is claimed is:

1. An exterior fire resistant passenger elevator system for rescuing fire victims who become trapped inside of a burning building, which building has a substantially horizontal top, a substantially vertical side and an inside, comprising:

a trolley machine car disposed on, and adapted to travel on, a circular rail track system mounted on the top of the building, the trolley machine car carrying a right rotary pulley wheel device and a left rotary pulley wheel device;

a elevator normally disposed exterior of the building and adjacent the substantially vertical side of the building;

a plurality of power transmission lines running between a source of electric power and the trolley machine car and the right and left pulley wheel devices;

a first cable riding on, and extendable from and retractable to, the right pulley wheel device;

a second cable riding on, and extendable from and retractable to, the left pulley wheel device;

the first and the second cable each separately connected to the elevator for lifting and maneuvering the elevator for rescuing fire victims who become trapped on the inside of the building.

2. An exterior fire resistant passenger elevator system according to claim 1, said building having a building electric power line, the source of electric power comprising a public utility supply line separate from the building electrical power line.

3. An exterior fire resistant passenger elevator system according to claim 1, the circular rail track system having steel rail tracks adapted to position the trolley machine car to rotate the elevator.

4. An exterior fire resistant passenger elevator system according to claim 1 wherein the trolley machine car has a steel frame and a steel chassis which are adapted for transporting equipment; and the trolley machine car has a motor positioned between the right rotary pulley wheel device and the left rotary pulley wheel device, and the first and second cable are separately connected to the elevator by being joined to top sections of the elevator with metal brackets, and further including clamps adapted for lifting and maneuvering the elevator by an operator or by programmers from a central station.

5. An exterior fire resistant passenger elevator according to claim 1 further comprising:

a plurality of elevator wheels mounted on the elevator; and a main vertical double tier track system consisting of groove centers and raised borders, the elevator wheels being contained on the inside of the main vertical double tier track system by the raised borders for vertical rotation of the elevator vertically.

6. An exterior fire resistant passenger elevator according to claim 1 further comprising:

a plurality of elevator wheels mounted on the elevator;

the elevator having an interior side, the interior side of the elevator having a top surface and a bottom surface;

a main vertical double tier track system having top tier vertical tracks consisting of groove centers and raised borders;

a plurality of hydraulic axles separately attached horizontally to the top surface and bottom surface of the interior side of the elevator;

a plurality of steel brackets each separately having a first prong and a second prong, the steel brackets each separately positioned over the top tier vertical tracks and connected to the elevator wheels at the first prong, and attached to the hydraulic axles the second prong.

7. An exterior fire resistant passenger elevator system according to claim 1 further comprising:

a horizontal steel rail track system;

a vertical rail track system, the horizontal steel rail track system being attached to the vertical rail track system, and the elevator being attached to the horizontal steel rail track system.

8. An exterior fire resistant passenger elevator system according to claim 1 further comprising:

a motor-driven vertical steel track system attached onto the substantially vertical side of the building and to the trolley machine car with fasteners and, at ground level, to steel and rubber base wheels;

horizontal steel tracks having an inside, the rubber base wheels being seated on the inside of, and movable along, the horizontal steel tracks in tandem with the trolley machine car across the substantially vertical side of the building.

9. An exterior fire resistant passenger elevator system according to claim 1 further comprising:

medical and fire fighting supplies comprising fire extinguishers, axes and first aid kits disposed within the elevator.

10. An exterior fire resistant passenger elevator system according to claim 1, the elevator having a motor-driven front door and a motor-driven rear door.

11. An exterior fire resistant passenger elevator system according to claim 1 wherein, the elevator has an inside floor, an end plate and a rear interior elevator door adapted for opening to a horizontally fixed position.

12. An exterior fire resistant passenger elevator system according to claim 1 further comprising:

the source of electric power is a generator.

13. An exterior fire resistant passenger elevator system according to claim 1 wherein the elevator has a steel slanted top.

14. An exterior fire resistant passenger elevator system according to claim 1 further comprising:

a plurality of hydraulic interior axles adapted to pull the elevator inward toward the building and push the elevator away from the building.

15. An exterior fire resistant passenger elevator system according to claim 1 further comprising:

monitors, sensors and timing devices.

16. An exterior fire resistant passenger elevator system according to claim 1 further comprising:

an exterior vertical and horizontal rail track system having rotary and flashing lights.

17. An exterior fire resistant passenger elevator system according to claim 1 further comprising:

a vertical main track system maneuverable across the side of the building;

a plurality of horizontal rail tracks having an inside and a plurality of wheels, and a plurality of axles attached to the wheels and movable on the inside of the horizontal rail tracks, the horizontal tracks adapted to transport and support the vertical main track system when maneuvered across the side of the building.

18. An exterior fire resistant passenger elevator system according to claim 1 further comprising:

a supplementary elevator, the elevator and the supplementary elevator adapted for distance sharing.

19. An exterior fire resistant passenger elevator system according to claim 1 further comprising:

a plurality of control bars extending from the trolley machine car comprising brackets adapted for securing the elevator and maneuvering it to a fixed position proximate the trolley machine car.

20. An exterior fire resistant passenger elevator system according to claim 1 wherein the elevator has an interior wall having windows adjacent the side of the building, the windows being adapted for providing access to the side of the building for extinguishing fires, maintenance and window washing.

21. An exterior fire resistant passenger elevator according to claim 1, wherein the trolley machine car has front section, a rear section and an interior side at the front section and at the rear section, further comprising:

a plurality of load balance stabilizers disposed on the interior side of the trolley machine care at the front and rear sections of the trolley machine car.

22. An exterior fire resisting passenger elevator system according to claim 1 further comprising:

an exterior rotary unit attached to the substantially vertical side comprising a plurality of hydraulic lifters, motors and pumps adapted for lifting the elevator.

23. An exterior fire resisting passenger elevator system according to claim 22 wherein the exterior rotary unit has a lower surface and a plurality of wheels attached to the lower surface of the rotary unit with a plurality of metal fasteners.

* * * * *